United States Patent [19]

Wygant

[11] 3,975,278

[45] Aug. 17, 1976

[54] TRACTANTS COMPRISING LINEAR DIMERS OF α-ALKYL STYRENE

[75] Inventor: James C. Wygant, Creve Coeur, Mo.

[73] Assignee: Monsanto Company, St. Louis, Mo.

[22] Filed: Feb. 12, 1975

[21] Appl. No.: 549,231

Related U.S. Application Data

[63] Continuation of Ser. No. 74,900, Sept. 23, 1970, abandoned.

[52] U.S. Cl. ..... 252/59; 74/200

[51] Int. Cl.[2] ..... C10M 3/10; F16H 15/08

[58] Field of Search ..... 252/73, 59; 74/200

[56] References Cited

UNITED STATES PATENTS

| | | | |
|---|---|---|---|
| 3,440,894 | 4/1969 | Hammann et al. | 74/200 |
| 3,577,361 | 5/1971 | Hammann et al. | 252/73 |
| 3,595,796 | 7/1971 | Duling et al. | 252/73 |
| 3,608,385 | 9/1971 | Duling et al. | 252/73 X |

*Primary Examiner*—Harris A. Pitlick

*Attorney, Agent, or Firm*—William H. Duffey

[57] ABSTRACT

Dimers of α-alkyl styrene consisting of linear dimers with up to about 20% of cyclic dimers are substantially completely hydrogenated to improve the coefficient of traction of the dimers and to yield a composition comprising a major proportion of compounds having the general structure

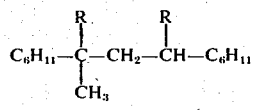

wherein each R is an alkyl of 1 to 4 carbon atoms.

These compositions are liquids which have good viscosity properties over a wide temperature range, have excellent oxidative stability, and are particularly useful as tractive fluids in applications requiring low temperature operability.

2 Claims, No Drawings

TRACTANTS COMPRISING LINEAR DIMERS OF α-ALKYL STYRENE

This is a continuation of application Ser. No. 74,900, filed Sept. 23, 1970 now abandoned.

BACKGROUND OF THE INVENTION

1. Field of the Invention

This invention relates to a method for improving the coefficient of traction of dimers of α-alkyl styrene by hydrogenation, and to tractive fluid compositions comprising a major proportion of hydrogenated linear dimers of α-alkyl styrene.

2. Description of the Prior Art

Traction is broadly defined as the adhesive friction of a body on the surface on which it moves. A tractive drive is a device in which torque is transmitted from an input element to an output element through nominal point or line contact typically with a rolling action by virtue of the traction between the contacting elements.

While tractive elements are commonly spoken of as being in contact, it is generally accepted that a fluid film is provided there between. Almost all tractive drives require fluids to remove heat, to prevent wear at the contact surfaces, and to lubricate bearings and other moving parts associated with the drive. Thus, instead of metal to metal rolling contact there is a film of fluid introduced into the load zone. The nature of this fluid determines to a large extent the limits of performance and the capability of the drive.

Many compositions have been suggested as tractive fluids, or tractants, for use in tractive drives with varying degrees of success. Some of these fluids are very efficient and effective tractants, but because of their relatively high cost have been restricted to specialty applications such as constant speed drives for aircraft generators. Other compositions are found to be unsuitable for low temperature operation due to high viscosity or a tendency to crystalize at temperatures of −20°F. or higher. In general, the tractive fluids heretofore have been expensive materials of limited application which required multicomponent blending and the use of additives in order to formulate compositions suitable for general use. For large volume utility applications, such as industrial drives and heavy duty vehicular drives for trucks and buses, less expensive fluids having a wide operable temperature range are sought.

It is accordingly an object of the present invention to provide an effective, efficient, and relatively low cost tractive fluid. It is a further object of this invention to provide an oxidatively stable tractant with an operable viscosity over a temperature range of from about −20° to 200°F. It is another object of this invention to increase the coefficient of traction of α-alkyl styrene dimers by hydrogenation to provide an improved tractive fluid.

SUMMARY

Linear dimers of α-alkyl styrene having the general structure

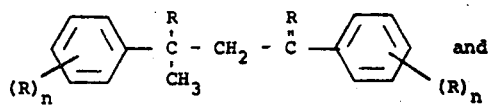

and

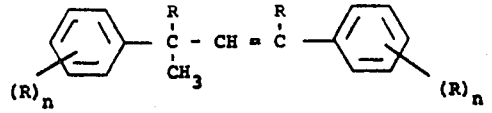

wherein each R is an alkyl of 1 to 4 carbon atoms and $n$ is 0 to 2 are substantially completely hydrogenated to provide a fluid comprising a major amount of fully saturated compounds of the general structure

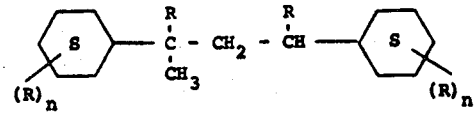

wherein $n$ and each R is the same as above.

Cyclic dimers of α-alkyl styrene having the general structure

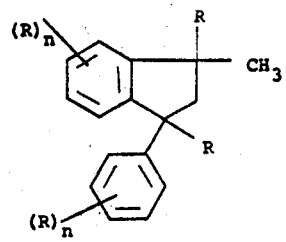

wherein each R is an alkyl of 1 to 4 carbon atoms and $n$ is 0 to 2 may be originally present in minor proportions, and are substantially completely hydrogenated together with the linear dimer.

The hydrogenated product is oxidatively stable, has good viscosity properties over a wide temperature range, has a high coefficient of traction and is particularly useful as a tractant in tractive drive apparatus.

DESCRIPTION OF PREFERRED EMBODIMENTS

The tractants of this invention comprise hydrogenated dimers of α-alkyl styrene. The hydrogenated linear dimers are found to have more favorable viscosity properties and greater oxidative stability than the hydrogenated cyclic dimers, and are accordingly the preferred compositions. Minor concentrations of cyclic dimers formed during the dimerization reaction can be tolerated without serious adverse effects on viscosity or oxidative stability. In general, it is preferable that the hydrogenated material contains less than about 20% of the cyclic compound, and more preferable 10% or less, although concentrations greater than 20% can be tolerated in applications wherein low temperature viscosity is not a critical limitation.

Although the alkyl group of the α-alkyl styrene can be from 1 to 4 carbon atoms, it is generally preferred that this alkyl group be methyl or ethyl. The preferred dimers are accordingly hydrogenated linear dimers of α-methylstyrene and α-ethylstyrene, hydrogenated linear co-dimers of α-methylstyrene and α-ethylstyrene, and mixtures thereof.

PREPARATION OF UNSATURATED DIMERS

Linear dimers of α-alkyl styrene can be prepared by polymerizing monomers of α-alkyl styrenes according to known techniques. Particularly preferred monomers include α-methylstyrene and α-ethylstyrene, and the ring substituted monomers such as methyl-α-methylstyrene, methyl-α-ethylstyrene, ethyl-α-methylstyrene, ethyl-α-ethylstyrene, isopropyl-α-methylstyrene, isopropyl-α-ethylstyrene, and the like.

Alpha-alkyl styrenes are readily polymerized to corresponding unsaturated dimers by contacting monomers of α-alkyl styrene with a minor proportion, e.g., 5% by weight or less, of a catalyst material such as a mixture of phosphorus oxyhalide and a small amount of a strong mineral acid.

The catalyst material can be a mixture of phosphorus oxychloride or phosphorus oxybromide and a strong mineral acid such as hydrochloric acid, hydrobromic acid, ortho-phosphoric acid, nitric acid, or sulfuric acid, or an aqueous solution of any of these acids in amounts corresponding to from 80 to 98 percent by weight of the phosphorus oxyhalide and from 20 to 2 percent by weight of the acid. Other catalyst including acidic clays such as activated montmorillonite and Lewis acid catalysts are also useful in the polymerization of α-alkyl styrenes.

The polymerization can be carried out by mixing a small amount of the catalyst material with the monomers and thereafter maintaining or heating the mixture at a reaction temperature between 0° and 130°C., preferably from 10° to 60°C. and at atmospheric pressure, although higher pressures may be used.

The unsaturated linear dimers formed consist of a mixture of the corresponding isomeric 1-pentene and 2-pentene derivatives. For instance, the unsaturated dimers of a α-methylstyrene are the isomeric compounds 2,4-diphenyl-4-methyl-1-pentene and 2,4-diphenyl-4-methyl-2-pentene, respectively. The relative proportion in which the 1-pentene and 2-pentene isomeric derivatives are formed appears to be dependent for the most part upon the temperature at which the polymerization reaction is carried out. At temperatures of from about 0° to 80°C., the polymerization reaction tends toward the formation of the unsaturated compound 2,4-diphenyl-4-methyl-1-pentene as the major component while at higher temperatures of from about 90° to 130°C., 2,4-diphenyl-4-methyl-2-pentene is usually found in amounts equal to or greater than the 1-pentene isomer. The particular isomer formed is of little importance to the present invention, however, since both isomers yield the same hydrogenated product.

The dimerization reaction is preferably conducted at temperatures or less than about 130°C. to encourage the formation of linear dimers in preference to cyclic dimers. Dimerization of α-methylstyrene at 100°C. in the presence of 0.50% montmorillonite catalyst provides about 80 mole percent conversion to unsaturated dimers consisting of about 97 weight percent linear dimer and 3% cyclic dimer. These unsaturated dimerized products are recovered from the unreacted monomers by distillation.

HYDROGENATION OF UNSATURATED DIMERS

Unsaturated dimers of α-alkyl styrene can be hydrogenated using conventional techniques. The hydrogenation is preferably carried out in the presence of molecular hydrogenation catalysts capable of promoting the hydrogenation such as, for example, metals, especially those of Group VI through Group VIII of the Periodic Table, or their compounds, particularly their oxides either alone or in various mixtures with each other, or on carrier materials such as silica, zinc oxide, alumina, charcoal, kieselguhr, etc.

The reaction can take place at temperatures from about 20°C. to 250°C. and at pressures of from about atmospheric to 2500 psig. The preferred operating conditions are generally from about 50° to 200°C. and from about 500 to 1500 psig. The hydrogenation of the unsaturated dimers is substantially complete so that less than about 2 percent, and preferably less than 0.5 percent unsaturation remains in the hydrogenated product.

The hydrogenation can be conducted in the presence of a suitable organic solvent, most often one which is inert to the hydrogenation conditions such as, for instance, paraffins, naphthenes and sterically hindered unsaturated hydrocarbons.

As stated above, the dimerization of α-alkyl styrene generally produces unsaturated dimer comprising a major proportion of linear dimer and from about 3 to 5% cyclic dimer. When hydrogenated, this composition is characterized by a high coefficient of traction, good high and low temperature viscosity characteristics, excellent resistance to oxidation, and performance which is generally superior to other known tractive fluids.

Coefficient of traction as reported herein was determined on a rolling disk machine. This machine was designed to predict the performance of a fluid in variable speed drives and comprises two hardened steel rollers which may be loaded one against the other and driven at any required speed. The fluid is introduced between the rollers and the relationships between applied load, roller surface speeds, relative sliding speed between the two rollers, and torque transmitted from one roller to the other through the contact between them are a measure of the potential performance of the fluid in a variable speed drive. Literature references on this rolling disk machine include M. A. Plint [Proceedings of the Inst. of Mech. Engrs., Vol. 180, pp 225, 313 (1965–66)]; "The Lubrication of Rollers, I" by A. W. Crook [Phil. Trans. A 255, 281 (1963*a*)].

The viscosity characteristics of the hydrogenated linear dimer of α-methylstyrene are unique and particularly desirable for a tractive fluid. This material maintains an operable viscosity from −20° to 200°F., an operating range and flexibility not found in known tractants. Most of the tractive fluids heretofore available are either solids or extremely viscous fluids at −20°F. Others which have an operable viscosity at −20°F. typically have an undesirably low viscosity at the higher temperatures. For most applications, it is preferable that the fluid have a viscosity of less than about 50,000 centistokes at −20°F. and more than about 3.5 centistokes at about 200°F. Hydrogenated linear dimer of α-methylstyrene containing 3% cyclic dimer has a viscosity of 31,600 centistokes at −20°F. and 3.7 centistokes at 200°F. Comparable viscosity data for several other tractants representative of the prior art are as follows:

| Tractant | Viscosity −20°F. | Viscosity 210°F. |
|---|---|---|
| Bicyclohexyl | Solid | 1.2 |
| x-Cyclopentylbicyclohexyl | Solid | 3.0 |
| 1,2-Tercyclohexyl | >200,000 | 4.3 |
| 1,3-Tercyclohexyl | Solid | 4.9 |
| Dicyclohexylmethane | Solid | 1.4 |
| 1,1-Dicyclohexylethane | <1000 | 1.7 |
| Cyclohexyl(x-ethylcyclohexyl)methane | <1000 | 1.7 |

-continued

| Tractant | Viscosity −20°F. | 210°F. |
|---|---|---|
| 1,1,3-Tricyclohexylpropane | >200,000 | 9.0 |
| Hydrogenated dicumyl | Solid | 4.8 |

The following examples illustrate the preparation of the compositions of this invention and their superior properties which make them particularly well suited for use as tractive fluids. In these examples, the linear dimer of α-methylstyrene was prepared according to the procedure hereinbefore described and contained about 3% cyclic dimer. References to hydrogenated linear dimers accordingly refer to the hydrogenated product of this material. The examples are directed specifically to compositions of α-methylstyrene as a preferred embodiment of the invention, and the invention is not limited thereto.

EXAMPLE 1

Hydrogenation of α-methylstyrene

A 1 liter autoclave was charged with 51 grams of Raney nickel catalyst and 600 grams of α-methylstyrene dimer which was a mixture of about 97%, 2,4-diphenyl-4-methyl-1-pentene and 2,4-diphenyl-4-methyl-2-pentene dimers and 3% cyclic dimer. The catalyst was Raney No. 28 which had been prepared for the hydrogenation reaction by displacing the water with ethanol.

The autoclave was flushed with hydrogen and pressured to 500 psig. The reaction was maintained at about 60°C. and 500 psig with agitation for an initial reaction period of about 2 hours, following which the autoclave was slowly heated to 180°C. and maintained at that temperature for about 3 hours. The hydrogenation was completed by increasing the temperature to 200°C. at 500 psig for about 1 hour. Total reaction time was 4 hours.

After cooling and venting, the reaction product was removed from the autoclave and filtered. NMR analysis of the filtrate showed essentially complete hydrogenation with less than 0.1% unsaturated remaining. Low boilers were removed by a vacuum distillation to a head temperature of 135°C./0.9 mm. The hydrogenated product was a colorless oil having a refractive index, $n_D$ 1.4878.

Anal: Calc. for $C_{18}H_{34}$: C, 86.3; H, 13.7. Found: C, 86.0; H, 13.9.

EXAMPLE II

The coefficient of traction of the hydrogenated linear dimer prepared in Example 1, of unhydrogenated linear dimer, and of hydrogenated cyclic dimer were determined on a rolling disk machine. The cyclic dimer was prepared by dimerizing α-methylstyrene at 150°C. and distilling the dimerized product to yield cyclic dimer containing about 1 percent linear dimer as a minor constituent. The following data were obtained at a fluid temperature of 200°F., a disk speed of 3,000 RPM with 1% slip, and a Hertz stress of 400,000 psi.

| Material | Avg. Coef. of Traction |
|---|---|
| Hydrogenated Linear Dimer | 0.094 |
| Hydrogenated Cyclic Dimer | 0.090 |
| Unhydrogenated Linear Dimer | 0.066 |

These data illustrate that hydrogenation increases the coefficient of traction of the linear dimer by a considerable degree, and that the coefficient of traction of hydrogenated linear dimer is higher than that of hydrogenated cyclic dimer.

EXAMPLE III

The hydrogenated linear dimer product of Example I and a sample of hydrogenated cyclic dimer were evaluated for oxidative stability under a standard Oxidation and Corrosion Test (O&C) according to Federal Test Method Standard 791-5308.4 with the following modification:

Temperature — 350°F.
Time — 72 hours
Air — 5 liters/hr.
Metals — Cu, Fe, Mg, Al

The results of this evaluation were as follows:

OXIDATION AND CORROSION TEST

| PROPERTY EVALUATED | LINEAR DIMER | CYCLIC DIMER | CONTROL |
|---|---|---|---|
| 100°F. Viscosity Increase | 2.5 | 9.0 | 2.4 |
| Fluid Acid Number | 0.17 | 0.63 | 0.1 |
| Corrosion, weight change, mg. per in² | | | |
| Cu | None | −0.04 | −0.01 |
| Fe | +0.01 | +0.02 | −0.01 |
| Mg | None | None | −0.01 |
| Al | None | None | −0.02 |

Control: Hydrogenated dicumyl

The excellent oxidative stability of the hydrogenated linear dimer as compared with the hydrogenated dicumyl control is most surprising on consideration of the difference in chemical structure of these compounds. The relationship of oxidation stability to compound type and structure is well recognized, and has been summarized for example by W. S. Dukek, J. Inst. Pet. 50, 276 (1964) as follows:

"Among hydrocarbons, alkyl aromatics are most easily oxidized, followed by diolefins, mono-olefins, and paraffins. Structure as well as type influence ease of oxidation. Tertiary hydrogen is most easily removed, followed by secondary and primary hydrogens. The resulting peroxides are stable in the same order." In the case of the present compounds, the control, hydrogenated dicumyl, has two tertiary hydrogen atoms attached to ring carbon atoms. The hydrogens however, are shielded by the cyclohexyl groups and by the methyl groups on adjacent carbon atoms, and are accordingly protected from oxidation. The linear dimer, on the other hand, has three tertiary hydrogen atoms, one of which is attached to a bridging carbon atom. This additional tertiary hydrogen atom not only increases the potential for oxidation, but also reduces the degree of shielding afforded the tertiary hydrogen on the adjacent ring carbon atom. Consequently, both these hydrogen atoms would be expected to be quite susceptible to oxidation, and it is quite surprising that, contrary to theory, the linear dimer appears equivalent to the hydrogenated dicumyl control in the above oxidation test.

EXAMPLE IV

The viscosity of the hydrogenated linear dimer prepared in Example I, and the effect of three conventional acrylate-type V.I. improvers on the viscosity was determined over a temperature range of −20° to 200°F. The measured viscosities in centistokes are given in the table below:

| FLUID | V.I. IMPROVER | TEMPERATURE, °F. −20 | 0 | 100 | 200 |
|---|---|---|---|---|---|
| 1 | None | 31,600 | 3,500 | 22 | 3.7 |
| 2 | 1.5% "A" | 33,300 | 3,400 | 26 | 4.5 |
| 3 | 1.5% "B" | 37,500 | 3,900 | 27 | 4.6 |
| 4 | 3.0% "C" | 42,000 | 5,600 | 33 | 5.5 |

"A" - alkylmethacrylate - vinyl pyrrolidone copolymer
"B" - long-alkylmethacrylate polymer
"C" - alkylmethacrylate polymer - low M.W.

Although the hydrogenated linear dimer alone has exceptionally good viscosity properties over a wide temperature range, a viscosity of about 4.5 centistokes at 200°F. is desirable for certain applications such as heavy duty vehicular drives. The preceding data illustrates that common V.I. improvers are effective in increasing the high temperature viscosity of the linear dimer to meet this specification without destroying the low temperature operability.

The low temperature viscosity of mixtures of linear and cyclic dimers of α-methylstyrenes were also measured to determine the maximum permissible concentration of the cyclic component. The compositions were prepared by combining the hydrogenated linear and cyclic dimers of Example II in the ratios specified below. The viscosity data illustrates that for applications which require low temperature operability, the maximum permissible concentration of cyclic dimer is limited to about 20%.

| | | | | | |
|---|---|---|---|---|---|
| linear/cyclic | 100/0 | 96/4 | 90/10 | 80/20 | 0/100 |
| actual % cyclic | 3 | 7 | 13 | 22 | 100 |
| −20°F. Visc. cs. | 31,600 | 32,400 | 36,700 | 52,400 | >200,000 |

It is generally preferred for most applications that the viscosity of the tractive fluid be less than 50,000 centistokes at the lower temperature in the operable range. Thus it is seen that at −20°F. the 80/20 mixture above is marginal for a low temperature tractive fluid, but the 90/10 mixture is completely satisfactory.

Although the preceding examples have related to α-methylstyrene, other $\alpha C_{1-4}$ alkyl styrenes can also be used with good results. The hydrogenated α-ethylstyrene dimers and co-dimers of α-ethylstyrene and α-methylstyrene are accordingly within the scope of the present invention.

It is also understood that special additives designed to enhance specific properties of the hydrogenated α-alkyl styrene dimer tractants can be included without departing from the spirit of the invention. Such additives include, for example, V.I. improvers, antioxidants, antiwear agents, corrosion inhibitors, dispersants, dyes, and the like. Accordingly, the scope of the present invention is not to be limited except as defined in the appended claims.

The embodiments of this invention in which an exclusive property or privilege is claimed are defined as follows:

1. In a method of operating a tractive device wherein torque is transmitted between relatively rotatable members having tractive surfaces in a torque transmitting relationship and having a tractant disposed on said tractive surfaces, the improvement comprising using as said tractant hydrogenated dimers of α-methyl styrene having less than about 2 percent unsaturation and a viscosity less than about 52,400 centistokes at −20°F. (−28.9°C.), the fully hydrogenated dimer consisting essentially of A. at least about 80 percent by weight of fully hydrogenated dimer of a linear dimer represented by the structure

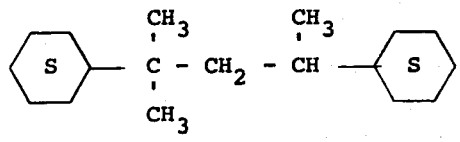

and

B. from 0 to about 20 percent by weight of fully hydrogenated dimer of a cyclic dimer represented by the structure

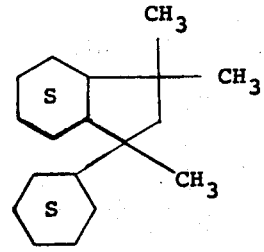

2. The method of claim 1 wherein the fully hydrogenated dimers consist essentially of from about 90% to 100% by weight hydrogenated linear dimer of α-methylstyrene and from 0% to 10% by weight hydrogenated cyclic dimers of α-methylstyrene.

* * * * *